United States Patent [19]

Parker et al.

[11] Patent Number: 4,808,882

[45] Date of Patent: Feb. 28, 1989

[54] HIGH PRESSURE DISCHARGE LAMP WITH OVERHUNG END ARC TUBE AND CERMET ENDS

[75] Inventors: Keith E. Parker, Rearsby; Martin G. Scott, Leicester, both of England

[73] Assignee: Thorn Emi plc, London, England

[21] Appl. No.: 892,818

[22] Filed: Aug. 4, 1986

[30] Foreign Application Priority Data

Aug. 3, 1985 [GB] United Kingdom ..... 8519582

[51] Int. Cl.[4] ..... H01J 61/36; H01J 61/30

[52] U.S. Cl. ..... 313/625; 313/634; 313/636

[58] Field of Search ..... 313/625, 624, 634, 636

[56] References Cited

U.S. PATENT DOCUMENTS

| | | | |
|---|---|---|---|
| 3,363,134 | 1/1968 | Johnson | 313/625 X |
| 3,564,328 | 2/1971 | Bagley et al. . | |
| 4,501,799 | 2/1985 | Driessen et al. | 313/636 X |
| 4,539,511 | 9/1985 | Denbigh et al. | 313/625 X |
| 4,665,344 | 5/1987 | Kajihara et al. | 313/624 |

FOREIGN PATENT DOCUMENTS

| | | |
|---|---|---|
| 1074124 | 6/1967 | United Kingdom . |
| 1361773 | 7/1974 | United Kingdom . |
| 1571084 | 7/1980 | United Kingdom . |
| 1582115 | 12/1980 | United Kingdom . |

*Primary Examiner*—Palmer C. DeMeo

*Attorney, Agent, or Firm*—Fleit, Jacobson, Cohn & Price

[57] ABSTRACT

An arc tube for a high pressure discharge lamp comprises a sealing element displaced from the end and sintered within the arc tube to form an overhung end. An electrically conductive cermet end member has a boss member which fits within a central aperture in the sealing element to thereby centralize the cermet end member within the arc tube. The cermet end member is therefore positioned within the arc tube independently of the arc tube wall and any distortion of the arc tube which has taken place during sintering of the sealing element has no effect. Preferred dimensions of the components are given so that cracking of the cermet end member is avoided and suitable electrical resistance is achieved.

15 Claims, 2 Drawing Sheets

HIGH PRESSURE DISCHARGE LAMP WITH OVERHUNG END ARC TUBE AND CERMET ENDS

FIELD OF THE INVENTION

This invention relates to ceramic arc tubes for high pressure discharge lamps wherein cermet members are used as closure members for the ends of the arc tube. Arc tubes for high pressure discharge lamps are made of light transmitting ceramic material, for example, polycrystalline alumina, sapphire or a spinel which is capable of resisting the corrosive attack of alkali metal vapours and metal halide vapours at the high temperatures which occur, for example, in high pressure sodium and metal halide lamps. The arc tubes are closed by suitable end closure members also capable of resisting the corrosive metallic or other vapours and hermetically sealed to the ends of the arc tube by suitable sealing compositions. In some cases electrically conductive cermet members have been proposed as end closure members for one or both ends of the arc tube for high pressure discharge lamps, such lamps being referred to herein as cermet ended lamps. An arc tube complete with sealed in electrodes, gas fill and end closure members is referred to herein as a discharge lamp arc tube.

DESCRIPTION OF RELATED PRIOR ART

Cermet ended lamps have been proposed as far back as 1964, more than 20 years ago, but to applicant's best knowledge no commercially accepted cermet ended lamps are yet on the market. UK Pat. No. 1,074,124, filed 1964 is one such early proposal and discloses electrically conductive lead-in members which are formed of particles comprising a core of fused silica coated wtih Rhodium. Rhodium being a member of the platinum group of metals is extremely expensive and a more practical proposal in UK No. 1074124 is the suggested use of alumina particles coated with tungsten. Even so, no commercial lamp of that type is available. Coming more up to date, UK specification No. 1361773 discloses as an end closure member, the use of an electrically conductive alumina-molybdenum cermet, with a volume fraction of 0.20 molybdenum. The cermet end closure member both carries the electrode support and acts as an electrical contact to the lamp. The principal advantage of this system is that the electrical lead in member does not pass through the cermet and closure member which avoids the difficulty of making a hermetic seal between the electrode lead in member and the end closure member. A disadvantage of the end design disclosed by this patent is that the expansion co-efficient of the cermet has to be carefully matched to the expansion of the alumina and a volume fraction as high as 0.20 is believed to produce cracking problems. In our UK Pat. No. 1571084 we disclose improved electrically conductive cermet members having lower volume fraction of metal, namely between 0.045 to 0.2 which have expansion co-efficients very close to that of pure oxide ceramic. All the embodiments described in our UK Pat. No. 1571084 make use of a sealing element which is sintered to the walls of alumina tube 3, see FIG. 5, to form a monolithic plug 4. Cermet cap 1 is joined to the monolithic plug 4 by a suitable sealing frit 2. Such a construction is now well known but a disadvantage is that the ends of the arc tube, that is walls 3 plus plug 4 require some kind of end preparation to ensure a flush surface ready for making the hermetic joint.

SUMMARY OF THE INVENTION

According to the present invention there is provided an arc tube for a high pressure discharge lamp, the arc tube being made of light transmitting ceramic material and having a sealing element of said ceramic material provided at least at one end of the arc tube, the sealing element being sintered to the arc tube wall to form a gas tight joint therewith and being displaced slightly inwards of the end of the arc tube, an electrically conductive cermet member complete with electrically conductive members attached thereto sealing the said at least one end of the arc tube, the cermet member having an end face, part at least of which abuts an end face of the sealing element, the said end faces being sealed together by means of a sealing composition.

An end design which would avoid end preparation is shown in U.S. Pat. No. 3,564,328, patented 1971 and UK Pat. No. 1 582 115, published 1980. Both of these patent specifications disclose the use of an alumina sealing element sintered to the arc tube wall in a gas tight manner and displaced slightly inwardly of the ends of the arc tube. However, neither of these patent specifications suggest the use of electrically conducting cermet members as end closure members. Part of the present inventive concept is the realisation that the overhung end formed by the walls of the arc tube and the inwardly displaced sealing element provides a convenient stop for location of a cylindrical electrically conductive cermet member.

In attempting to make such a construction, however, we have found a particular problem is the distortion of the overhung end due to shrinkage during the sintering of the sealing element. Not only does this prevent proper centralisation of the cermet member but, also, it is difficult to ensure that the sealing composition actually contacts the sides of the cermet member located within the overhung end. From the above brief description it is quite apparent the seemingly simple job of providing a cermet ended discharge lamp is, in fact, quite complex and involves achieving a proper balance between such interacting properties as the electrical resistance of the cermet, its expansion properties to match alumina, the physical dimensions to accommodate electrode shanks and electrical inlead members without cracking and the ability to provide an hermetic seal between the cermet end member and the arc tube.

BRIEF DESCRIPTION OF THE DRAWINGS

One embodiment of the present invention will now be described by way of example only and with reference to the undernoted drawings wherein.

DESCRIPTION OF PREFERRED EMBODIMENTS

Figure 1:
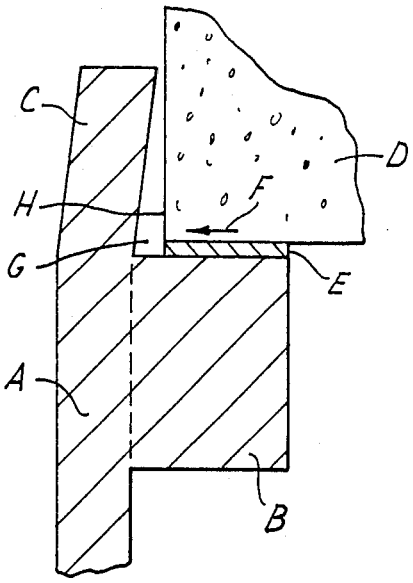
FIG. 1 is a diagrammatic illustration (much exaggerated in size) showing some of the problems associated with producing a cermet ended discharge lamp.

In FIG. 1, A represents an alumina arc tube complete with inwardly displaced alumina sealing element B sintered to the arc tube wall, represented by the dotted line, to form a hermetic joint with A. In practice, of course, no such joint line is apparent when a truly monolithic structure is obtained. Part C together with sealing element B form a so called overhung end in which electrically conducting cermet member D is situated. It has been found that end C distorts during sintering and forms a tapered end by as much as 1 or 2 degrees. One effect of this is to make the tolerance on the outside diameter of the cermet member extremely critical since any interference will prevent the proper insertion of the cermet within the overhung end. Another problably more disadvantageous effect is the fact that the movement of sealing composition E in the direction of arrow F by capillary action is interupted and stopped by the sudden increase in area at G. Consequently no adequate sealing can take place along the side H of cermet D. The solution according to the present invention to these and to other problems are set forth in more detail in the following description.

Figure 2:
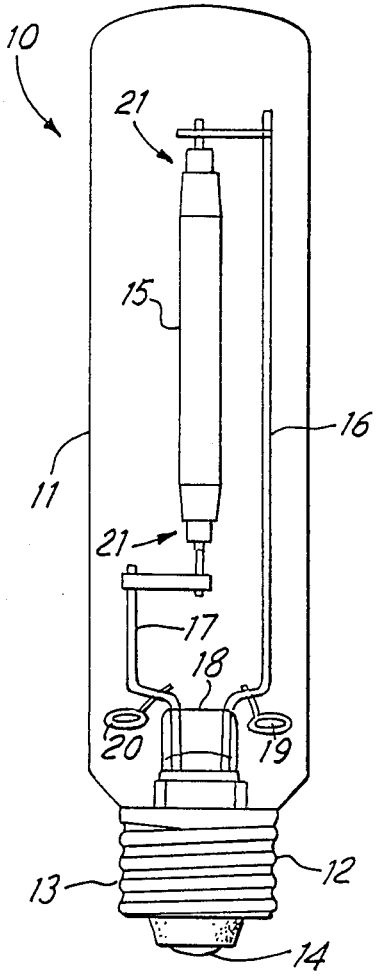
FIG. 2 is a view generally of a gas discharge lamp in accordance with the invention.

In FIG. 2, 1 a 70/50W high pressure sodium discharge lamp is shown generally at 10. Lamp 10 comprises an outer glass envelope 11 sealed to lamp base 12 in the form of an Edison screw 13 with electrical terminal 14. A discharge lamp arc tube 15 containing a sodium amalgam, mercury and a quantity of rare gas to aid starting, is carried by stainless steel frame members 16, 17 embedded in glass flare 18. Getter rings 19 and 20 which absorb hydrogen impurities produced during processing are also carried on frame members 16, 17 respectively. Operating conditions are arranged such that sodium amalgam temperature at the coolest point of the arc tube 15 will be in the range 650°–850° C. Discharge lamp arc tube 15 has an electrode assembly 21 located at each end and which is described in greater detail with reference to FIG. 3.

Figure 3:
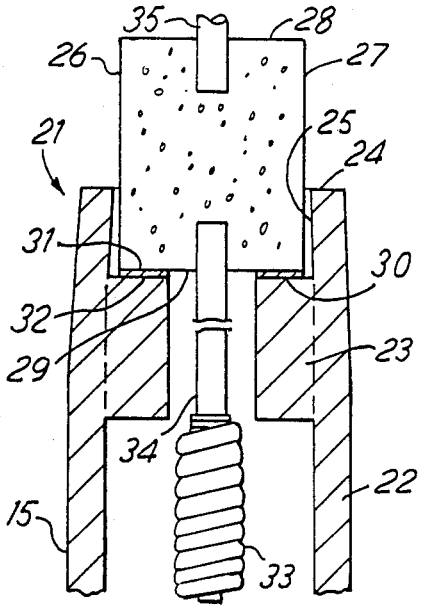
FIG. 3 is a part sectional view of one end of a discharge arc tube in accordance with the invention.

In FIG. 3 reference numeral 21 depicts generally one end of the 70/50W high pressure sodium discharge lamp of FIG. 2. The other end may be the same or may be different. End 21 comprises an arc tube 15 having envelope walls 22 of polycrystalline alumina. Sealing element 23, also of polycrystalline alumina, is sintered to envelope walls 22 whereby a hermetic joint represented by the dotted line is achieved between them. Sealing element 23 is displaced slightly inwards from the end 24 of the discharge arc tube 15 to form an overhung end 25. Electrically conducting lead in member 26 in the form of an electrically conductive cylindrical cermet member 27 has end faces 28, 29 and is sealed within overhung end 25 by means of sealing glass 30 selected to be compatible with alkali metal, metal halide or other discharge vapours. A part 31 of end face 29 forms the sealing surface and abuts end face 32 on sealing element 23 to provide a hermetic seal. The sealing element 23 thereby forms a stop member which properly locates the cermet member 27 in one sense within the overhung end 25. Electrode member 33 which is of the overwound coil type complete with electron emissive material is carried by tungsten shank member 34 embedded in cermet member 27 as is electrical connecting lead in member 35.

Figure 4:
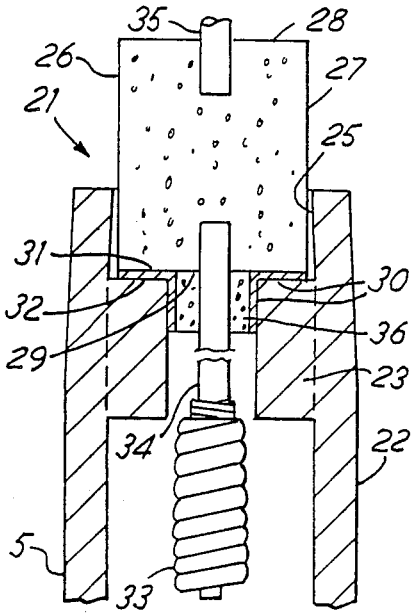
FIG. 4 is a part sectional view of one end of a discharge arc tube in accordance with another embodiment of the invention.

The FIG. 4 embodiment is similar to the FIG. 3 embodiment except that electrically conducting member 27 has a boss portion 36 added which projects from end face 29. This forms a means of locating the cermet member within the overhung and centralises the cermet member and thereby the electrode within the arc tube 15 on the main central lamp axis. This method of locating the cermet member is independent of the outside diameter of the cermet and therefore the problem of the tapering effect of the overhung end can be overcome. In addition the length added by the boss member 36 increases the seal length so that the seal length 31 plus the seal length of the boss adds to the hermetic seal between the cermet member and the arc tube provided at 31, FIG. 3. For a 70W lamp a seal length of between 2 and 3.5mm. will give satisfactory sealing without the need to seal down the sides of the cermet. In a 400W lamp the corresponding dimension would be between 4.6mm and 6mm (It will be appeciated that whereas seal length is referred to, in fact, a seal area is produced).

The boss portion 36 in FIG. 4 reinforces the basic cylindrical cermet member 26 and, of course, the longer the boss length the better the sealing effect. However, with too long a boss there can be problems with cracking and a long boss is difficult to press. We have found that a minimum boss length of 1mm is required for adequate sealing while a maximum of about 2.5mm can be easily pressed. In general a ratio of boss length to boss diameter of less than or equal to 3 gives satisfactory results.

Figure 5:
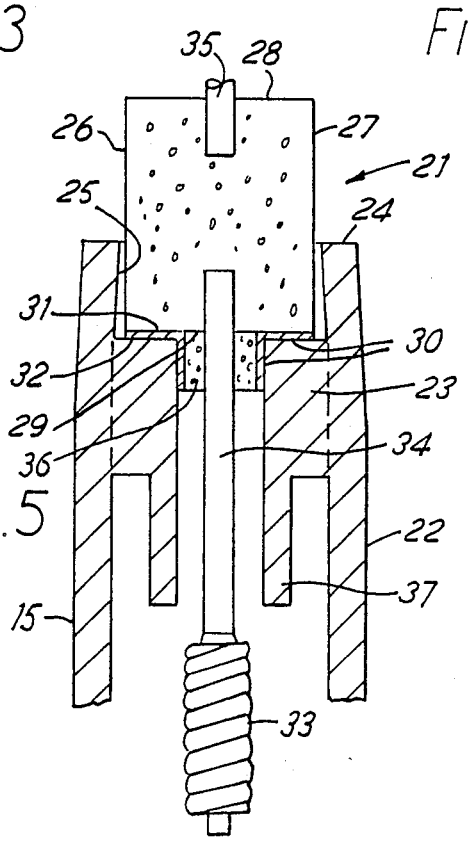
FIG. 5 is a part sectional view of one end of a discharge arc tube in accordance with another embodiment of the invention.

The FIG. 5 embodiment is similar to the FIG. 4 embodiment except that sealing element 23 includes a shoulder member 37. In this example shoulder member 37 is formed integrally with sealing element 23. Shoulder member 37 prevents conductive liquid metal amalgam formed during lamp operation from settling on electrode 33 so that during starting the arc tends to strike the amalgam rather than the electrode giving rise to the phenomenon of rectification which is detrimental to lamp operation. The provision of the shoulder member, therefore, prevents rectification which is much more prone to occur in high pressure sodium discharge lamps of relative low wattage. Under these circumstances it will be appreciated that the reservoir formed by the shoulder member 37 will have a minimum volume sufficient to accommodate the amalgam within the arc tube. In FIG. 5, the backspacing of the electrode, which is the distance from the face 29 of cermet 26 to the end of the electrode 33 remote from face 29, is sufficient to take the electrode 33 past the shoulder member 37. In some cases the electrode 33 may be within or partially within the shoulder member 37.

A variety of electrically conductive cermet compositions may be used in the present invention. However, electrically conductive cermets disclosed and claimed in our UK Pat. No. 1 571 084 are preferred because they have a good expansion match with alumina. Such cermets have electrical resistances in the overall range 5–25 milliohm with a preferred resistance varying between 10 to 15 milliohms. This overall range ensures that during operation of a 70W lamp the increase in resistance due to increase in temperature does not exceed 100 milliohms. Hence the $I^2R$ losses for a lamp current of 1A rms would be the order of 0.1 W/end which is considered acceptable. For a 400 W lamp the corresponding figures would be a preferred resistance of 10 to 15 milliohm giving an $I^2R$ loss of less than 1.0W per end for steady-state lamp current of 4.5A rms.

Another important aspect of the cermet design is the depth of insertion of the electrically conducting member electrode shank 34. Electrical connection can be improved and good electrical connection achieved if the electrode shank penetrates into the main body of the cermet by at least 0.25mm. On the other hand if it penetrates too far there is a danger of cracking especially if electrical lead in member 35 penetrates a similar distance. A maximum penetration of about 0.75mm of each, into the main body of the cermet has been found to be suitable to avoid cracking problems. Good electrical connection is important because the overall electrical resistance can affect the end temperature of the lamp. In addition the diameter of the electrode shank may be varied between 0.5mm and 0.8mm to give greater or less conduction of heat from the electrode 33 to the end of the lamp. By varying the above parameters and properly selecting the electrode back space length a discharge lamp can be provided having an operating end temperature between 600° C. and 850° C.

High pressure sodium discharge lamps having at least one end designed in accordance with the present invention have achieved satisfactory lives on test. Lamps tested in accordance with the present invention had lamp discharge arc tubes with an overall length of 80mm and inside diameter of 4mm. The electrically conducting cermet members had a body diameter of 3.8mm and length 4mm while the boss diameter was 1.75mm with a length of 1.0mm. Electrode shank and lead in members were both 0.5mm diameter with a backspace distance of 8.5mm. In the manufacture of the monolithic arc tube the sealing element was displaced inwardly a distance of 1.75mm to form the overhung end.

We claim:

1. An arc tube for a high pressure discharge lamp, the arc tube comprising a tubular wall made of a light-transmissive, ceramic material; a ceramic sealing member positioned inwardly with respect to an end of the tubular wall and being sealed to an internal surface thereof, the sealing member having an outer face and a central bore, and a cermet member comprising a block of an electrically conductive cermet material having a first end and a second end and an electrical lead-in member and an electrode-supporting shank set into said first end and said second end respectively, the block being so positioned that said electrode-supporting shank extends through said bore into the interior of the arc tube and said second end of the block is sealed to said outer face of the sealing member thereby to seal said end of the arc tube.

2. An arc tube according to claim 1 wherein the cermet member has an electrical resistance in the range from 5 millohms to 25 milliohms.

3. An arc tube according to claim 2 wherein the cermet member has an electrical resistance in the range from 10 milliohms to 15 milliohms.

4. An arc tube according to any one of claims 1 to 3 wherein said sealing member has a shoulder member arranged to prevent rectification during starting when the arc tube is used in a discharge lamp.

5. An arc tube for a high pressure discharge lamp, the arc tube comprising a tubular wall made of a light-transmissive, ceramic material; a ceramic sealing member positioned inwardly with respect to an end of the tubular wall and being sealed to an internal surface thereof, the sealing member having an outer face and a central bore, and a cermet member comprising a block of an electrically conductive cermet material having a first end and a second end and an electrical lead-in member and an electrode-supporting shank set into said first end and said second end respectively, the block being so positioned that said electrode-supporting shank extends through said bore into the interior of the arc tube and said second end of the block is sealed to said outer face of the sealing member thereby to seal said end of the arc tube, the electrode-supporting shank having an end which is set into said first end of the block at a depth of from 0.25mm to 0.75mm.

6. An arc tube according to claim 5 wherein said electrode-supporting shank has a diameter in the range from 0.5mm to 0.8mm.

7. An arc tube according to claim 5 wherein the cermet member has an electrical resistance in the range from 5 milliohms to 25 milliohms.

8. An arc tube according to claim 7 wherein the cermet member has an electrical resistance in the range from 10 milliohms to 15 milliohms.

9. An arc tube according to any one of claims 5 to 8 wherein said sealing element has a shoulder member arranged to prevent rectification during starting when the arc tube is used as a discharge lamp.

10. An arc tube for a high pressure discharge lamp, the arc tube comprising a tubular wall made of a light-transmissive ceramic material; a ceramic sealing member positioned inwardly with respect to an end of the tubular wall and being sealed to an internal surface thereof, the ceramic sealing member having an outer surface and an axially-extending cylindrical bore; and a cermet member comprising a block of an electrically-conductive cermet material, the block having a first end and a second end formed by an annular end surface and a cylindrical boss projecting from said annular end surface, an electrical lead-in member set into said first end of the block and an electrode-supporting shank set into said boss; wherein said boss fits within the bore of said sealing member so that said annular end surface of said second end is positioned adjacent to said outer surface of the sealing member and said electrode-supporting shank extends through the bore into the interior of the arc tube, the boss and the annular surface of said second end of the block being sealed by means of a sealing material to respective facing surfaces of the sealing member, thereby to seal said end of the arc tube and the block being so dimensioned that the boss, and the sealing material, extend part-way only along said bore of the sealing member.

11. An arc tube according to claim 10 wherein said boss has a length in the range from 1mm to 2.5mm.

12. An arc tube according to claim 10 wherein said facing surfaces extend axially and radially and have a total length in the axial and radial directions in the range from 2mm to 6mm.

13. An arc tube according to claim 12 wherein said length is in the range from 2 to 3.5mm.

14. An arc tube according to claim 12 wherein said length is in the range from 4mm to 6mm.

15. An arc tube according to claim 12 wherein the boss has a diameter and a length in the ratio less than or equal to 3.

* * * * *